US005176383A

United States Patent [19]

Duclos

[11] Patent Number: 5,176,383

[45] Date of Patent: Jan. 5, 1993

[54] GOLF CLUB

[76] Inventor: Clovis R. Duclos, 3661 Venture Dr., Huntington Beach, Calif. 92649

[21] Appl. No.: 784,712

[22] Filed: Oct. 30, 1991

[51] Int. Cl.[5] ..... A63B 53/04

[52] U.S. Cl. ..... 273/167 H; 273/171; 273/173

[58] Field of Search ..... 273/77 R, 167-175, 273/194 B, 78

[56] References Cited

U.S. PATENT DOCUMENTS

| | | | |
|---|---|---|---|
| 1,444,409 | 2/1923 | Willmott | 273/169 |
| 1,673,973 | 6/1928 | Drevitson | 273/167 F |
| 1,975,307 | 10/1934 | Ackerman | 273/170 |
| 2,346,617 | 4/1944 | Schaffer | 273/169 |
| 3,547,445 | 12/1970 | Hardesty | 273/173 |
| 3,567,228 | 3/1971 | Lynn | 273/173 X |
| 4,067,572 | 1/1978 | Coleman | 273/173 X |
| 4,076,254 | 2/1978 | Nygren | 273/173 |
| 4,535,990 | 8/1985 | Yamada | 273/167 H X |
| 4,730,830 | 3/1988 | Tilley | 273/171 |
| 4,732,389 | 3/1988 | Kobayashi | 273/169 |
| 4,756,534 | 7/1988 | Thompson | 273/171 |
| 4,811,949 | 3/1989 | Kobayashi | 273/171 |
| 4,944,515 | 7/1990 | Shearer | 273/167 H |
| 5,000,454 | 3/1991 | Soda | 273/167 H |

*Primary Examiner*—V. Millin
*Assistant Examiner*—Sebastiano Passaniti
*Attorney, Agent, or Firm*—Pillsbury Madison & Sutro

[57] ABSTRACT

A golf "wood" club whose head includes a weight positioned behind the center of percussion of the club head face to promote energy transfer to a golf ball. The head can be manufactured from traditional materials such as wood, but in its preferred embodiments, it is constructed from composite or metal material with an embedded faceplate reinforced by a support member that extends rearwardly and spaces the weight from the faceplate to increase the moment of inertia of the club about a vertical axis and reduce flexure of the faceplate.

10 Claims, 1 Drawing Sheet

GOLF CLUB

TECHNICAL FIELD OF THE INVENTION

This invention relates to golf clubs and, more particularly, to construction of advanced "woods".

BACKGROUND OF THE INVENTION

In the game of golf, "drivers" and "woods" are used when it is desired to hit the golf ball as far as possible. Usually a "driver" or 1 wood is used when the ball is hit from a tee and a 2, 3, 4, or 5 wood is used when the golf ball is on the fairway. Traditionally, clubs are constructed from wood. However, some woods are being cast in metal or composite material. The main advantage of such metal or composite clubs over woods constructed from wood, is that the physical qualities, such as weight, density and hardness, of the material used are more easily controlled. This gives the designer more shape and construction latitude and allows the clubs to be more uniformly made with less waste than wood. With wood, flaws can appear during the last manufacturing steps after substantial expense has been incurred.

Heel and toe weighting (that is providing extra material or auxiliary weights on the sides of a club about its striking surface or face), has been a popular expedient with putters and irons, golf clubs normally used when shorter but more accurate ball direction paths are desired. This is because the heel and toe weighting increases their moment of inertia or resistance against twisting. With less club twist, a miss-hit ball diverges less from the intended path. Heel and toe weighting also is appearing in metal and composite woods which, like wood woods, usually are uniformly weighted side to side with a sole plate on the underside thereof.

With clubs intended to hit a golf ball maximum distances such as drivers and other woods, there has been a continuous effort by club designers to provide clubs that transfer maximum energy into the golf ball at the instant of striking. One means is to increase the possible club head speed generated by the user by providing a club with less aerodynamic drag than traditional spoon-shaped clubs as shown in U.S. Pat. No. 4,444,392 by Clovis R. Duclos. However, from the results achievable from different clubs, it is clear that club head speed is only one of many factors that affect the maximum energy that can be transferred into a golf ball. Such factors that have been examined in the past include face hardness, center of gravity position, hosel length, shaft stiffness and shaft length. However, most of these factors interplay with a golfer's ability to control the club or are useful parameters for change only to a limited few, very strong or very athletic golfers. Therefore, there has been a need to provide a wood type golf club which can be used by ordinary golfers to increase their drive distance without requiring extraordinary golfing skill.

BRIEF DESCRIPTION OF THE INVENTION

In the present invention, a relatively thick, ball striking faceplate is provided for a wood-type club that has a support member or integral support portion which extends to the rear of the club to provide additional stiffness to the plate. A weight can be provided at the rear of the support in line with the center of percussion of the club, to concentrate its inertial energy thereat and impart maximum energy to a golf ball being stricken by the club. In most instances, the support is tubular so that it reinforces the faceplate, making it stiffer without significant weight. The support for the faceplate and the relative thickness thereof reduces face flexure. Flexure of the faceplate otherwise can significantly reduce energy transfer to the ball.

The club usually is constructed from graphite composite material although the invention can be used in both metal woods and those made from traditional wood material. In some embodiments, the faceplate, weight and support therebetween are adhesively retained within the club, while in others, screws or other fasteners are employed. The combination of weight exactly behind the center percussion of the club and the front to back spacing of the mass of the faceplate and the rearward weight result in a club with a high moment of inertia similar to that achieved with heel and toe weighting, but without the disadvantage of faceplate flexure therebetween.

Therefore, it is an object of the present invention to provide a golf club with weight concentrated behind the center of percussion to impart maximum energy into a golf ball being struck.

It is another object of the present invention to provide a "wood" golf club whose body can be constructed from composite, metal, or wood that has a high moment of inertia against the twisting that can occur when a ball is struck at a location other than the center of percussion of the club.

Another object is to provide a wood with a supported, relatively thick faceplate for greater stiffness thereof.

Another object is to provide a golf club that can be used by average golfers to both increase the accuracy and distance of their drives.

Another object is to provide an improved "wood" golf club that can be manufactured uniformly and whose overall swing weight can be adjusted during final assembly of the club.

These and other objects and advantages of the present invention will become apparent to those skilled in the art after considering the following detail specification, together with the accompanying drawing wherein:

DETAILED DESCRIPTION OF THE PRESENT EMBODIMENTS

Figure 1:
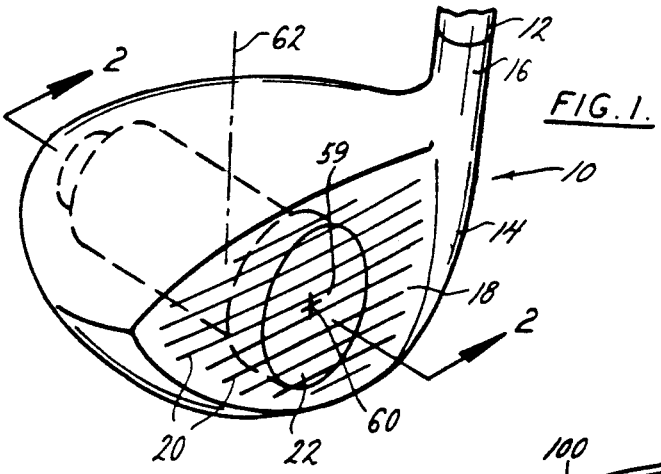
FIG. 1 is a perspective view of the head end of a golf club employing features of the present invention.

Referring to the drawing more particularly by reference numbers, 10 in FIG. 1 refers to a golf club whose shaft 12 is only partially shown. The club 10 includes a golf club head 14, having a hosel 16 into which the shaft 12 is inserted and attached. The head 14 also has a front ball striking surface 18, having score lines 20 horizontally thereacross.

Figure 2:
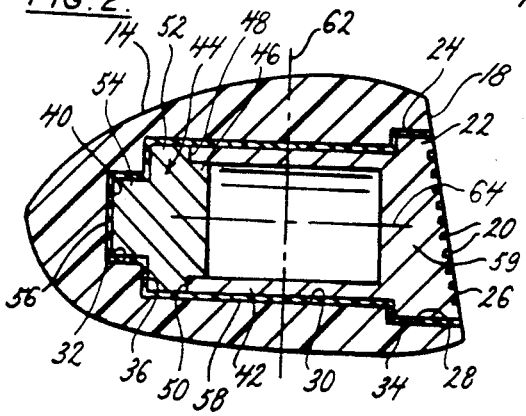
FIG. 2 is a cross-sectional view of a modified form of FIG. 1.

As can be seen in FIG. 2, a faceplate member 22 is nested in a cavity 24 extending from the front ball striking surface 18 of the head 14. The member 22 also has a front (ball striking surface 26 which lies generally planer to the front ball striking surface 18, to form one continuous surface. The cavity 24 includes three interior cylindrical surfaces 28, 30 and 32 with a radial surface 34 between surfaces 28 and 30 and a radial surface 36 between cylindrical surfaces 30 and 32. A third radial surface 40 forms the rear portion of the cavity 24.

The faceplate member 22 includes an integral tubular portion 42 which extends rearwardly toward radial surface 36. A weight 44, in the form of a plug for the tubular portion 42, has a cylindrical portion 46 that extends within the tubular portion 42 to assure alignment therewith. A flange 48 on the weight engages the rearward radial surface 50 of the tubular portion 42 to assure inertial transfer when the front ball striking surface 26 actually engages a golf ball. The weight also includes a second cylindrical portion 52, having an outer diameter similar to that of the tubular portion 42 and a third cylindrical portion 54 which nests with cylindrical surface 32. The weight 44 has a rear radial surface 56 which mates with the radial surface 40. The faceplate member 22 and the weight 44 are retained within the cavity 24 by a thin layer of adhesive 58. Adhesive can also be used to connect the weight 44 to the tubular portion 42 to assure that no rattling occurs when a ball is struck.

Preferably, the head 14 is constructed from graphite composite which is light and very strong. Its lightness allows a large proportion of the weight of the club head to be concentrated in the weight 44 and the faceplate 22. Although the face place member 22 can have a faceplate and a tube constructed from different materials having different densities, when constructed integrally as shown, it is preferable that the member 22 be constructed from an aluminum alloy such as aluminum titanium. Sufficient forward mass and stiffness of the faceplate portion 59 can be obtained with such materials, and yet they are light enough that the tubular portion 42 does not significantly contribute to the total weight of the head 14. Preferably, the weight 44 is constructed from brass or other heavy material whose dimensional stability can be maintained.

The faceplate member 22 and the weight 44 are positioned so that the center of percussion 60, shown in FIG. 1, is centered on the faceplate surface 26 for maximum energy transfer to a golf ball. The weight 44 and faceplate portion 59 act about a vertical axis 62 to provide a high moment of inertia thereabout to resist twisting should a ball be struck laterally on the surfaces 18 or 26 from the center of percussion 60. The central axis 64 of the tubular portion 42 preferably is in side to side alignment with the center of percussion 60.

Figure 3:
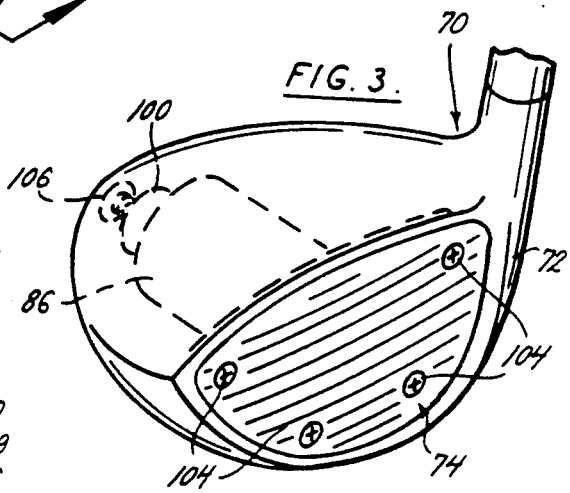
FIG. 3 is a perspective view of a modified form of the present invention.
Figure 4:
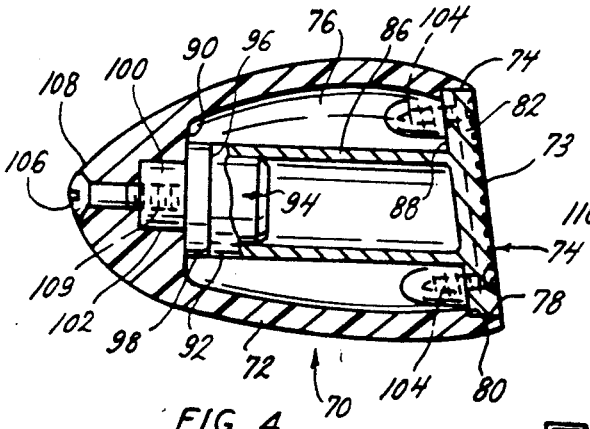
FIG. 4 is a partial cross-sectional view of the club of FIG. 2, of FIG. 3 showing the internal structure thereof.

In FIG. 3, a similar club 70 is shown, having a head 72 where the entire front ball striking surface 73 is formed on the faceplate member 74. As shown in FIG. 4, the head 72 includes a large cavity 76 with an opening 78 having a flange 80 thereabout at the forward portion thereof. The faceplate member 74 includes a relatively large and thick faceplate portion 82 which has the ball striking surface 73 thereon. A tubular weight support member 86 extends from the rear surface 88 of the faceplate portion 82 toward the rear surface 90 of the cavity 76. Although the opposite end 92 of the tubular member 86 can nest in the head 72 to assure that the faceplate portion 82 does not flex, in FIGS. 3 and 4, it is shown having a heavy plug 94 fit therein.

The plug 94 includes a radial flange 96 which engages the rear radial surface 98 of the tubular member 86 to assure inertial transfer therebetween. Like the weight 44, the plug 94 includes a rearward facing cylindrical pin portion 100 which nests within a similarly-shaped cylindrical cavity 102 in the head 72 to assure alignment of the entire structure and resist any rattling. The plug 94 and faceplate portion 74 usually are adhesively retained to the head 72. The plug 94 is also adhesively retained within the tubular member 86. However, for additional security, screws 104 can be extended through the faceplate portion 82 into the head 76 to assure that the faceplate member 74 and the plug 94 are retained therein. Additionally, a machine screw 106 can be placed through the rear 108 of the head 72 into a suitably-threaded hole 109 in the plug 94 for further security.

Figure 5:
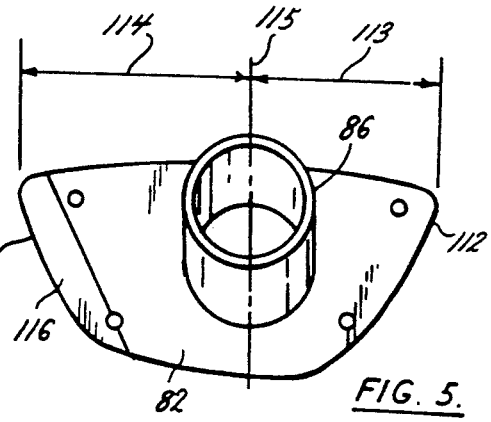
FIG. 5 is a rear view of the faceplate of FIGS. 3 and 4.

As shown in FIG. 5, the faceplate portion 82 extends on the heel side 110 of the head 72 further from the tubular member 86 than on the toe side 112 as shown by the differing lengths of arrows 113 and 114. Since the tubular member 86 preferably is aligned with the center of percussion, its horizontal location being shown by line 115, the rear of the faceplate portion 82 is relieved in the area indicated by numeral 116 to balance the faceplate member 74 and assure a proper location of the center of percussion.

Figure 6:
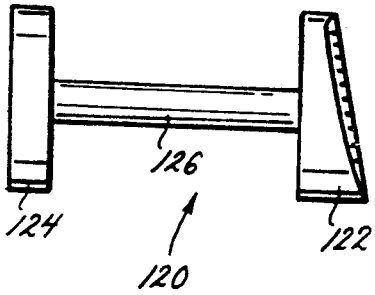
FIG. 6 is a side plan view of an integral weighted faceplate constructed according to the present invention.

In FIG. 6, an integral faceplate member 120 is shown with its faceplate portion 122, similar to that of faceplate member 22, being spaced from an integral weight 124 by a rod 126. It should be noted that the outer diameters of the faceplate portion 122 and the weight 124 are similar so that the member 120 can be used in a conventional wood club with a hole bored in what would normally be the front face thereof.

Therefore, there has been shown and described novel golf clubs which fulfill all the objects and advantages sought therefor. Many changes, modifications, variations and other uses and applications of the subject golf clubs will become apparent to those skilled in the art after considering this specification and the accompanying drawing. All such changes, modifications, variations and other uses and applications that do not depart from the spirit and scope of the invention are deemed to be covered by the invention which is limited only by the claims which follow.

I claim:

1. A golf club head having:

a body which includes:

a front portion;

a rear portion; and a cavity extending from said front portion toward said rear portion; and faceplate means extending across said cavity at said front portion, said faceplate means including:

a faceplate surface for striking a golf ball;

a tubular support portion which extends to said rear portion of said head in said cavity; and a faceplate integral with said tubular support portion, said faceplate surface being positioned on said faceplate, said faceplate including:

a rear portion connecting to said tubular support portion;

a toe side having:

a relieved portion at said rear portion of said faceplate; and a heel side, said support portion being positioned closer to said toe side than said heel side an amount being generally balanced by said relieved portion, said head further including:

a weight positioned at least in part in said tubular support portion spaced from said faceplate toward said rear portion of said head, said weight and faceplate thereby providing a high moment of inertia which acts to reduce twisting of the head when miss hit while concentrating their mass behind said faceplate surface.

2. A golf club head having:

a body constructed from a material having a first density, said body including:

a front portion;

a sole portion including:

a lower sole surface;

rear portion including:

a support pocket; and a cavity extending from said front portion toward said rear portion, said cavity being defined by an inner wall; and faceplate means constructed from a material having a second density greater that said first density, said faceplate means extending across said cavity at said front portion, said faceplate means including:

a faceplate surface for striking a golf ball;

a tubular support portion spaced from said inner wall and extending to said rear portion of said head in said cavity generally parallel to said lower sole surface; and a faceplate integral with said tubular support portion, said faceplate surface being positioned on said faceplate, said head further including:

a separate weight constructed from a material having a third density greater than said second density, said weight being positioned partially in said tubular support portion spaced from said faceplate toward said rear portion of said head, said weight and faceplate thereby providing a high moment of inertia which acts to reduce twisting of the head when miss hit while concentrating their mass behind said faceplate surface, said separate weight including:

a support extension that nests within said support pocket.

3. The golf club head as defined in claim 2 wherein said separate weight and faceplate are adhesively retained within said body cavity.

4. The golf club head as defined in claim 2 wherein said faceplate surface includes:

a center of percussion, and said tubular support portion has a central axis extending in a line from said faceplate surface to said rear portion which generally aligns with said center of percussion horizontally.

5. A golf club head having:

a body including:

a front portion;

a sole portion including:

a lower sole surface;

a rear portion; and a cavity extending from said front portion toward said rear portion, said cavity being defined at least in part by an inner wall;

a faceplate member extending across said cavity at said front portion, said faceplate means including:

a faceplate portion having:

a faceplate surface for striking a golf ball; and a rear surface;

a hollow tubular support portion integral with said faceplate portion extending from said rear surface of said faceplate portion toward said rear portion of said head in said cavity, said hollow tubular support portion being orientated generally parallel to said lower sole surface; and a separate weight nested partially in said tubular support portion spaced from said faceplate portion toward said rear portion of said head, wherein said rear portion includes:

a support pocket, said hollow tubular support portion includes:

a rear end;

a radial end surface at said rear end thereof, and wherein said separate weight includes:

a cylindrical portion which is positioned within said tubular support portion;

a flange which is positioned adjacent said radial end surface; and a rearwardly extending cylindrical portion which nests in said support pocket in said rear portion of said body.

6. The golf club head as defined in claim 5 wherein said separate weight is constructed from material that is heavy in relation to the material from which said faceplate member is constructed, and said faceplate member is constructed from material that is heavy in relation to the material from which said body is constructed and having a volume so that its mass approaches the mass of said separate weight, said separate weight and faceplate member thereby providing a high moment of inertia against twisting of said head while concentrating mass behind said faceplate surface generally in horizontal alignment with the center of a golf ball being hit.

7. A golf club head having:

a body including:

a front portion;

a sole portion including:

a lower sole surface;

a rear portion; and a cavity extending from said front portion toward said rear portion, said cavity being defined at least in part by an inner wall;

a faceplate member extending across said cavity at said front portion, said faceplate means including:

a faceplate portion having:

a faceplate surface for striking a golf ball; and a rear surface;

a hollow tubular support portion integral with said faceplate portion extending from said rear surface of said faceplate portion toward said rear portion of said head in said cavity, said hollow tubular support portion being orientated generally parallel to said lower sole surface; and a separate weight nested partially in said tubular support portion spaced from said faceplate portion toward said rear portion of said head, wherein said hollow tubular support portion includes:

an inner cylindrical surface;

an outer cylindrical surface;

a first end at said faceplate portion; and a second opposite end, said second opposite end having:

a radial ring surface extending between said inner and outer cylindrical surfaces, and wherein said separate weight includes:

a cylindrical plug portion having:

a cylindrical surface in contact with said inner cylindrical surface; and a flange portion having:

a forward facing radial surface extending outwardly from said cylindrical surface of said cylindrical plug in abutment with said radial ring surface.

8. The golf club head as defined in claim 7 wherein said separate weight is constructed from material that is heavy in relation to the material from which said faceplate member is constructed, and said faceplate member is constructed from material that is heavy in relation to the material from which said body is constructed and having a volume so that its mass approaches the mass of said separate weight, said separate weight and faceplate member thereby providing a high moment of inertia against twisting of said head while concentrating mass behind said faceplate surfaced generally in horizontal alignment with the center of a golf ball being hit.

9. The golf club head as defined in claim 7 wherein said rear portion of said body includes:

a generally vertical rear abutment surface; and a support pocket formed in said rear abutment surface, said flange portion of said separate weight including:

an outer cylindrical flange surface having a diameter similar to the diameter of said outer cylindrical surface of said hollow tubular support portion; and a support extension which nests within said support pocket.

10. The golf club head as defined in claim 9 wherein said rear portion of said body includes:

an orifice therethrough, said support extension includes:

a threaded opening therein, and wherein said head includes:

a threaded fastener that extends through said orifice and is threadably attached to said threaded opening to secure said weight to said body.

* * * * *